US005857278A

United States Patent [19]

Perkins, Jr.

[11] Patent Number: 5,857,278

[45] **Date of Patent: *Jan. 12, 1999**

[54] IMAGE SUPPORT APPARATUS

[76] Inventor: Raymond C. Perkins, Jr., 1730 N. Clark St., Apt. 714, Chicago, Ill. 60614

[ * ] Notice: The term of this patent shall not extend beyond the expiration date of Pat. No. 5,461,804.

[21] Appl. No.: 473,565

[22] Filed: Jun. 6, 1995

Related U.S. Application Data

[63] Continuation-in-part of Ser. No. 91,768, Jul. 14, 1993, Pat. No. 5,461,804.

[51] Int. Cl.[6] ..... A47G 1/06; G09F 17/00

[52] U.S. Cl. ..... 40/790; 40/603

[58] Field of Search ..... 40/152.1, 603, 40/152, 156, 617, 790; 248/316.7, 201; 38/102.91

[56] References Cited

U.S. PATENT DOCUMENTS

| | | | |
|---|---|---|---|
| 3,080,166 | 3/1963 | Clark | 40/603 |
| 3,245,165 | 4/1966 | Podoloff | 248/467 X |
| 3,419,988 | 1/1969 | Misauskas | 40/152.1 |
| 3,671,004 | 6/1972 | Crom | 248/467 |
| 4,106,852 | 8/1978 | Chasins | 248/165 X |
| 5,461,804 | 10/1995 | Perkins, jr. | 40/152.1 |
| 5,586,401 | 12/1996 | Sheehan et al. | 40/737 |

*Primary Examiner*—Cassandra H. Davis

*Attorney, Agent, or Firm*—Lee, Mann, Smith McWilliams, Sweeney & Ohlson

[57] ABSTRACT

An image or object support apparatus holds and displays an image or object, such as a photograph, drawing or other graphic work in a spaced position relative to a backing plate. The backing plate is itself supported in the place of display, as by picture hanging means or a stand. The image or object is supported by struts having grippers enabling easy changing of the image or object, and easy adapting to images of various size.

5 Claims, 4 Drawing Sheets

IMAGE SUPPORT APPARATUS

This application is a continuation-in-part of application Ser. No. 08/091,768 filed Jul. 14, 1993, from which U.S. Pat. No. 5,461,804 issued.

FIELD OF THE INVENTION

This invention is generally related to image display devices and is specifically related to an apparatus capable of supporting an object such as a photograph, drawing, or other graphic work in a spaced position relative to a base for easy changing of the image or object, and easy adapting to images of various sizes.

BACKGROUND OF THE INVENTION

DESCRIPTION OF RELATED ART

Prior art picture frames generally hold an image or object inside of some type of framework. A common type of picture holder is the slotted frame. Typically, the frame requires a paper backing or the like to be placed in the slots behind the photograph. A picture or other artwork is then supported in a position relative to the backing. Often slotted frames are clumsy, unattractive, and make framing artwork awkward.

Other types of display devices utilize a wire bracketing engaging the corners of the artwork to hang the framed image or object. Most of these wire hangers, like the slotted frame require the image or object to be mounted on some form of rigid backing, otherwise, the object may be damaged.

Some display frames will hold an image by interlocking it with a flexible "picture wire". Flexible wire is looped through each of four brackets. Similar to dinner plate hangers, these devices use wires that are held in tension and apply compression to the object in order to hold up the object. However, many images such as ordinary photographs will bend if placed under in compression in a device like this.

Alternative prior art framing approaches also include a combination of slots and magnets to hold the image. Some devices use combinations of adhesives and magnetic mounting devices. Specific male and female configurations are also available with mechanical securement means. A magnetic "L" shaped bracket has been used in the prior art as well. Notwithstanding the variety of display devices, the prior art all suffer from the fact they are complicated to construct and/or use, and if the user is not careful, the artwork may be damaged.

Other known prior art display devices include a changeable display construction as shown in U.S. Pat. No. 3,419,988. This structure is designed to make outside sign displays simpler to change. This display structure consists of a main support plate having rods attached at each corner of the support plate. The rods are of a relatively large diameter and must be sufficiently stiff to support displays of significant weight. Hence, this design is impractical for household picture display.

A need exists for an apparatus capable of supporting an art objects such as a picture, image and the like, suitable for household use, simple to use and construct which supports artwork such as an image, photograph or other small object without compressing or bending it.

SUMMARY OF THE INVENTION

The subject invention is an apparatus for display of a substantially planar object comprising a base, a means for supporting the object, and a means for holding the object. The base comprises a front surface, a back surface, and a peripheral edge extending around outer perimeter of the base. The means for supporting is connected to the front surface of the base and projects outwardly from the base. The holding means is attached to the means for supporting. The base may be of planar, rectangular or square shape, forming a first plane. A preferred embodiment uses a three dimensional formed or sculptured base which is nevertheless generally planar. The object is supported in a spaced relationship with the front surface of the base.

On the back surface of the base, optional spacers or other similar means for mounting may be attached. Hence, the present invention may be hung on a wall, on a traditional picture hanger, nail or the like, or placed using a stand, as on a table or the like.

In the preferred embodiment, the means for supporting the object comprises a plurality of struts projecting outwardly from the base. The struts are capable of supporting an art object in a spaced relationship with the base to form a second plane substantially parallel to the first plane or the base. Preferably, the struts are flexible and extend in a generally C-shaped manner having certain portions are substantially parallel to the first plane and other portions substantially perpendicular to the first plane. The means for supporting may be comprised of a variety of materials including a wide variety of metals, and plastic as polyvinylchlorides (PVC). Resilient wires or flexible plastic material is particularly suitable for the means for supporting.

The C-shaped arrangement allows the struts to be bent slightly inwardly or outwardly to accommodate square or rectangular images of varying dimensions or non-rectangular images such as photographs cropped for certain effects. In addition, C-shaped struts may be deformed to differ the top and bottom radii so as to impart the appearance of a tilt, either upwardly or downwardly, to improve an observer's sight of the image or object, and to reduce glare and the like. C-Shaped struts may also be deformed to change the lateral spacing between the means for holding in order to adapt to different images.

The means for supporting has two ends, a first and second end, the first end being attached to the base. Attached to the second end of the means for supporting is a means for holding the object. The preferred holding means is spring loaded clip or other similar attachment. However, a wide variety of holding means may be used or implemented. In the preferred embodiment of the present invention, the holding means is a clip. Preferably, the clip is molded with a portion integral with the stout. Separate clips may be fastened to the strut. The image or object such as a photograph is then clipped into place on the supporting means thereby being spaced away from the first plane and giving a "floating" appearance.

Alternative embodiments of the subject invention include various types of means for supporting the object. For example, one alternative supporting means includes straight, rod-like struts having threaded ends to fit threaded receptacles that may be placed at selected spaced positions on the base. Rod-like struts accommodate the varied shaping of objects, however not to the infinite degree of the C-shaped wires. On the other hand, with the rod-like strut, the holding means may comprise paired parallel or downwardly converging, U-shaped channels that have closed bottoms defining slots in which a photographic image or object may be placed. This type of slot arrangement provides the most rigid structure. Alternatively, magnetic elements may be placed on the outer surface of the image or object in close proximity with magnetized rods, providing greatest protection for the image or object against scratching or the like. Another known variation of the subject invention is to use a springy C-shaped wire or strap which tends to put outwardly directed loads on the corners of a photograph, thereby tending to hold it flat.

The subject invention offers an artwork display device that is economic and has a pleasing and a distinctive appearance. This economical construction is adaptable for displaying various size images. Advantages to the configuration of the present invention include the pleasing appearance, the ability to rapidly and easily change the image or object to suit decorative, subject or other purposes, adaptability to different size images and the ability to use various media for images, whether on paper, transparencies or the like.

DETAILED DESCRIPTION OF THE PREFERRED EMBODIMENT

Figure 2:
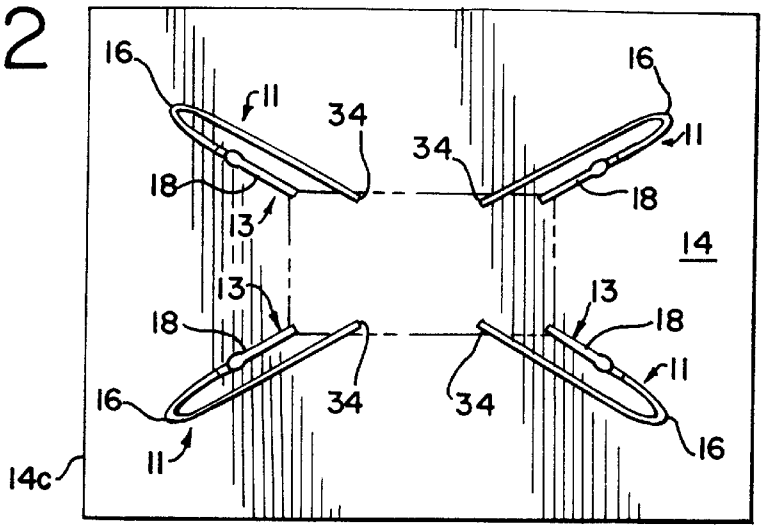
FIG. 2 is front elevational view of the first alternative embodiment.

As shown in FIGS. 1 through 17, the subject invention is an apparatus 10 capable of supporting an object 12. The apparatus comprises a base 14 having a front surface 14*a*, a back surface 14*b* and a peripheral edge 14*c* extending around said base 14, a means for supporting the object 11 in a spaced relationship with the front surface 14*a*, and a means for holding 13 the object. The means for supporting 11 is connected to the base 14 and projects outwardly from the base 14. The base 14 may be of planar, rectangular or square shape which forms a first plane. The means for supporting 11 has a first 11*a* and second end 11*b*. The first end 11*a* is connected to the base 14 and the second end 11*b* is connected to the means for holding 13.

The base 14 can be any material finished for pleasing appearance which has the necessary structural support. The base 14 may be constructed of any one of a variety of materials including wood, plastics such as polyvinyl chloride (PVC) or metal materials such as polished aluminum/stainless steel or polished aluminum and the like and is preferably rigid. It is preferred in this application that the base be formed in configurations other than the flat plate shown. For example as shown in FIGS. 14 through 17, the appearance of the base 14 could be enhanced by the use of a sculptured concave or convex surface or a combination of these complex surfaces without departing from the invention. Similarly, the means for supporting 11 and the means for holding 13 may also be made from a variety of materials including but not limited to metal or plastics such as PVC. The means for supporting 11, the means for holding 13 and the base 14 may be constructed of the same materials, or may made of a different materials.

A first alternative embodiment is shown in FIGS. 1 through 4. Here, the base 14 is a rectangular planar surface. The means for supporting 11 comprises struts 16 that project outwardly from base 14. As shown, the struts are made of metal wire. Each strut 16 has a base leg 30 merging into a curve leg 32 to form a C shape. The curved leg 32 terminates at the second end 11*b* where the means for holding 13 is formed or attached. The means for holding is a clip 18 formed at the first end 20 of strut 16 which is adapted to grip image or object 12. In this embodiment, clip 18 comprises a first jaw 22 and second jaw 24 connected at pivot 26 so as to capture image or object 12 therebetween.

Figure 3:
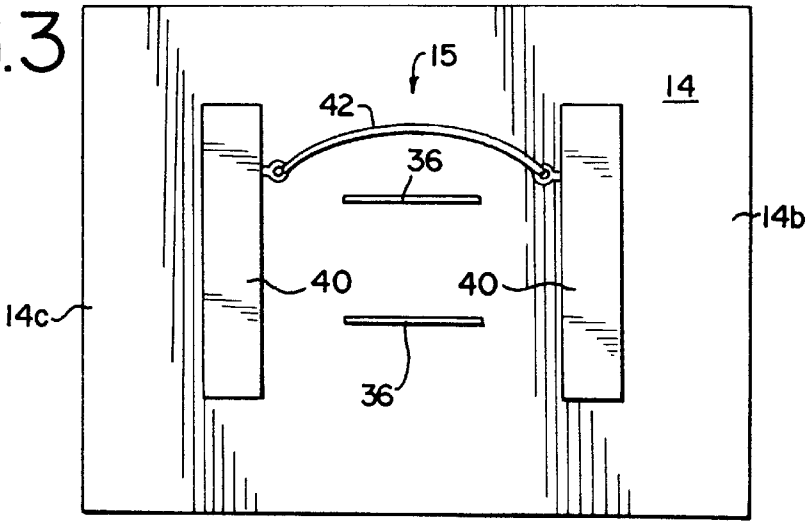
FIG. 3 is rear elevational view of the first alternative embodiment.
Figure 1:
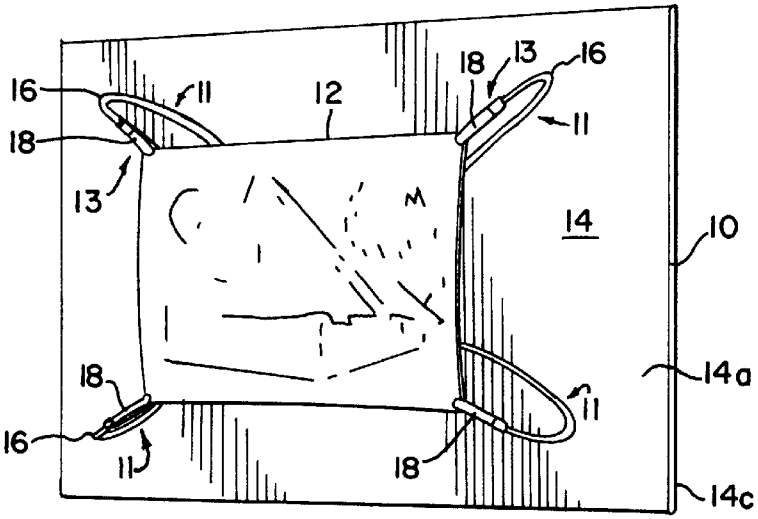
FIG. 1 is a perspective view of a first alternative embodiment.

As also shown in FIGS. 1 through 3, the strut 16 is formed with leg 30 and 32 such that it describes a "C" shape thereby enabling clip 18 to lie with jaws 22, 24 nearly parallel to base 14. In this manner, certain advantages are presented. For example, leg 30 can be arranged to terminate where it is affixed to the base 14. It can be formed as one continuous piece, or made to snap-fit into the base 14. Where wire is used, the preferred way of attaching this fixed end is to bend it to abut the back surface 14*b* and glue it in place, fastened so as to captive the strut. This is clearly shown in FIGS. 11 and 13.

Another advantage to the "C" shape of strut 16 is that it can be readily manipulated to form struts of varying depth and width relative to the lateral spacing between the means for holding 13 so that images of varying geometry can be accommodated. For example, in the preferred embodiment, a somewhat wider spacing of each clip 18 can be provided permitting the struts 16 (here shown as resilient wires) to be resiliently deformably or closed in to grip the image or object 12. This type of configuration assists in holding the image or object 12 in a more or less flat position particularly useful when unmounted photographic paper is used which has a tendency to curl owing to the development process. Other methods of mounting the strut 16 to the base 14 could be used without departing from the invention.

As shown in FIGS. 2 4, 11 and 13, another advantage to the "C" shape is that legs 30 may terminate by passing them through apertures 34. Therefore the first end 11*a* will be generally hidden from most angles for viewing the image or object by virtue of the placement of the image or object 12 substantially in front of apertures 34. This then in conjunction with using resilient wires finished along the same manner as base 14 enhances an aesthetically pleasing "high tech" appearance while accentuating the functional and utilitarian attributes of the invention.

Figure 4:
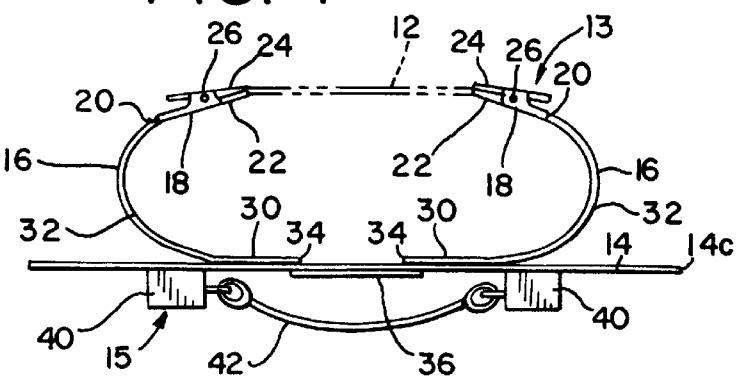
FIG. 4 is a top plan view of the first alternative embodiment.

The subject invention may optionally comprise a means for mounting 15. Examples of such means for mounting 15 are shown in FIGS. 4, 9, 13 and 17. In FIG. 4, for example, the means for mounting 15 are braces 40 that can be mounted to the back surface 14*b* of the base 14, or other hanging attachments 42, such as picture wire to hang on a hook from a wall (not shown). The braces 40 provide additional rigidity against bending of base 14, provide for placement of the mounting apparatus 42 as well as spacing the base 14 some distance from the wall thereby enhancing the aesthetic appearance and also enabling clearance for the passage of crossing portion 36 of the wire composing struts 16.

Figure 5:
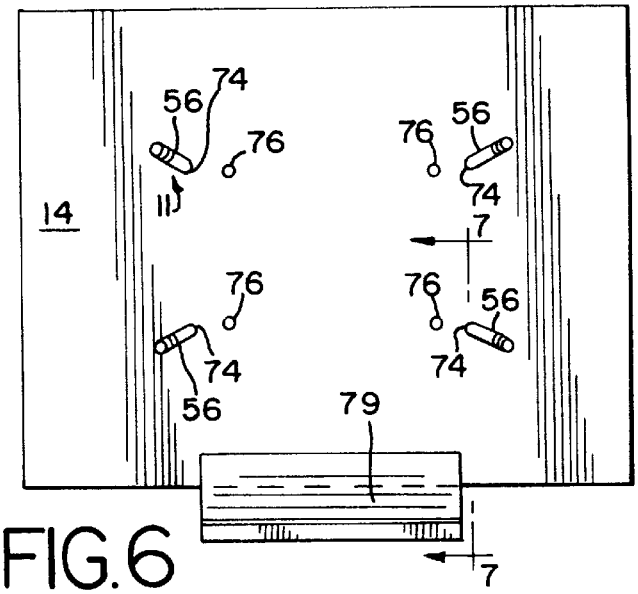
FIG. 5 is a perspective view of a second alternative embodiment.
Figure 7:
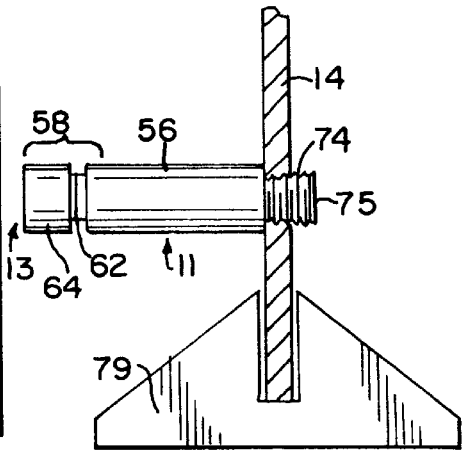
FIG. 7 is a sectional view of the second alternative embodiment.
Figure 6:
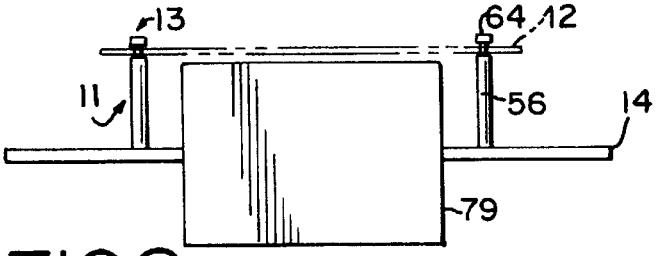
FIG. 6 is a top plan view of the second alternative embodiment.

FIGS. 5 through 7 shows a second alternative preferred embodiment of the subject invention. In this first alternative embodiment, the means for supporting 11 comprises straight struts 56 that are substantially rigid members of cylindrical form mounted perpendicularly to base 14. In this embodiment, the means for holding 13 is gripping assembly 58 supported by the struts 56 and comprising a first magnetic element 62 and a second magnetic element 64. The magnetic elements 62 and 64 are held together with magnetic force sufficient that image or object 12 can be held in place using a plurality of strut-magnetic element combinations. Preferably, four strut-magnetic element combinations are be used. Straight strut 56 is preferably a non-ferrous material such as an aluminum tube with a ferrous insert attracted to magnetic element 64. Alternatively, straight strut 56 may be composed of a ferrous or magnetic material, dispensing with a separate element, while performing the same function, namely attracting element 64, a magnet or complimentary ferrous material.

In this alternative embodiment, it would be preferred to have at least a first plurality of apertures 74 aligning each of the struts 56 with an image or object 12 of a certain perimeter. A second plurality of apertures 76 could be used to change the lateral spacing and/or perimeter of the strut array to conform to a different size image. Preferably, apertures 74, 76 are threaded. In this event, a threaded end 78 of the struts 56 is used for ease of manual movement. This arrangement provides for an aesthetically pleasing retention of the image or object 12 with the supports entirely hidden and the friction caused by the magnetic attraction between elements capturing the image or object providing the means for support. A stand 79 is illustrated which can be utilized to support the base 14 on a horizontal surface such as a table top. This stand 79 could be used on the other embodiments as well. While magnetic attractive elements 62, 64 are preferred, it may be advantageous to use alternatives such as elements composed of a material having electrostatic attraction or adhesive attraction.

Figure 8:
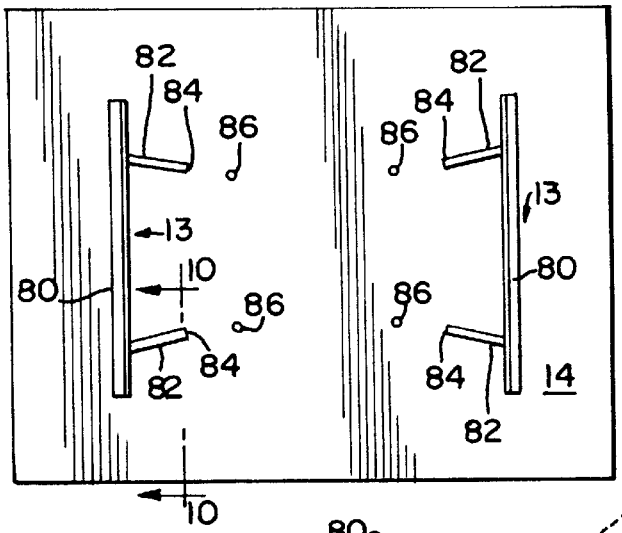
FIG. 8 is a perspective view of a third alternative embodiment.
Figure 10:
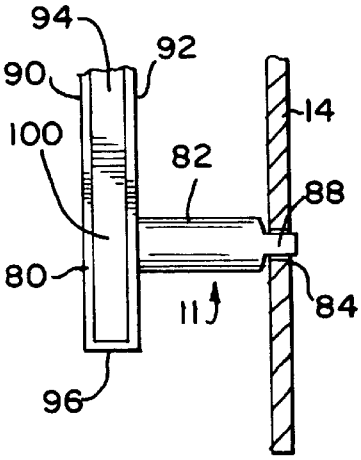
FIG. 10 is a sectional view of the third alternative embodiment.
Figure 9:
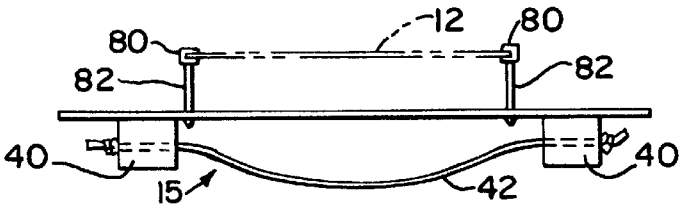
FIG. 9 is a top plan view of the third alternative embodiment.
Figure 12:
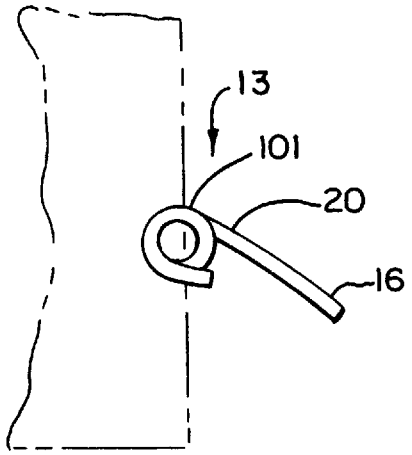
FIG. 12 is a partial front elevation of the fourth alternative embodiment.

A third alternative preferred embodiment is shown in FIGS. 8 through 10. In this embodiment, the means for holding 13 comprises a pair of opposed brackets 80 mounted on the means for supporting 11. As clearly depicted in FIG. 10, brackets 80 have a front flange, 90 a rear flange, 92, a side web 94 joining the flanges 90, 92, and a bottom stop, 96. The flanges 90, 92, web 94 and stop 96 define a slot 100 between them. The image or object 12 can be fitted in the slot 100 and rest on stop 96.

In this embodiment, the means for supporting 11 comprises rigid struts 82. The rigid struts 82 are fitted in a plurality apertures 84 in the base 14, with another array of apertures 86 adapted to receive the struts 82 for different lateral spacing. Because brackets 80 are mounted onto the rigid struts 82, it is preferable to use a pin end 88 rather than threading struts such as shown in FIG. 7. Pin end 88 can be adapted to a compression fit in aperture 84.

Figure 11:
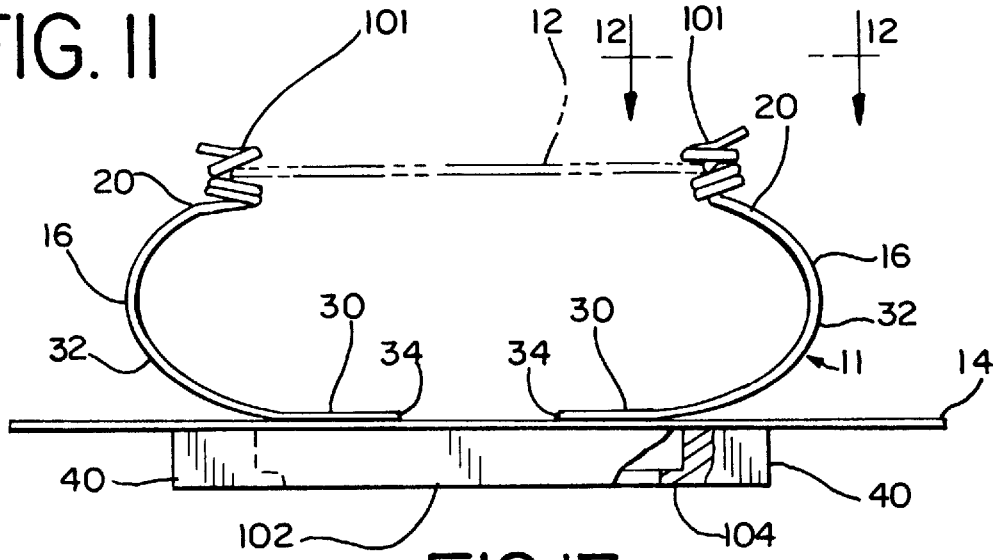
FIG. 11 is a top plan view of a fourth alternative embodiment.
Figure 13:
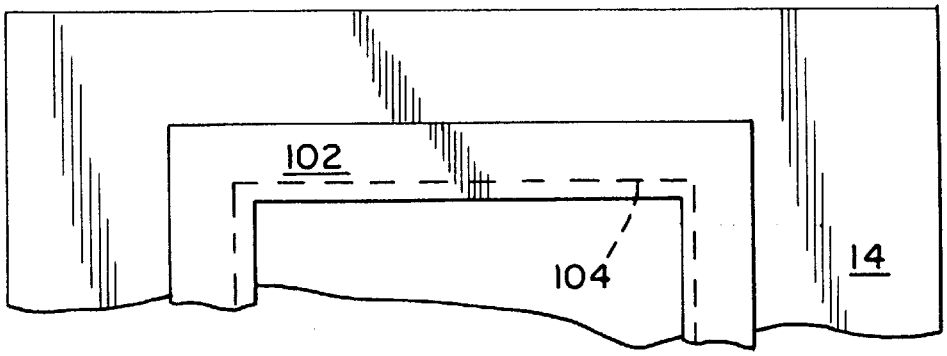
FIG. 13 is a partial rear elevation of the fourth alternative embodiment.

A fourth alternative embodiment is shown in FIGS. 11 and 13. In this embodiment, like the first alternative embodiment, the means for supporting 11 is a strut 16. The strut 16 is integrally connected to a means for holding 13 at the second end 20. The means for holding 13 comprises a helical coil 101 to holds the image or object 12. By opening the helical coil 101, through pressure by the edge of the image, or by a fingernail, the image 12 can be place between coils, utilizing the tensile strength of the coil to hold the image in place.

The hanger as shown in FIG. 13, is preferred in this embodiment. The means for mounting 15 is an expanded plastic, foam hanger 102 which may be die cut, or molded. The foam hanger 102 is formed with walls 103 arranged in the shape of square or a rectangle, with the interior of the square or rectangle proportionately removed, leaving a void in the interior of the square or rectangle. Rim 104 may be formed to grip a hanger, hook or nail in a wall. The resilient foam is readily deformable, so rim 104 can be dispensed with as a fastener, such as a nail with a head, to become partially embedded in the foam. This shape is then attached to the back of the frame and can be utilized to hang or mount the support apparatus. This foam hanger 102 can also serve to attach C-shaped wires to rear of plate 14 by means of compressing them between foam hanger 102 and base 14 with any suitable adhesive. As described earlier, the strut 16 can be captured between the foam hanger 102 and plated in.

Figure 15:
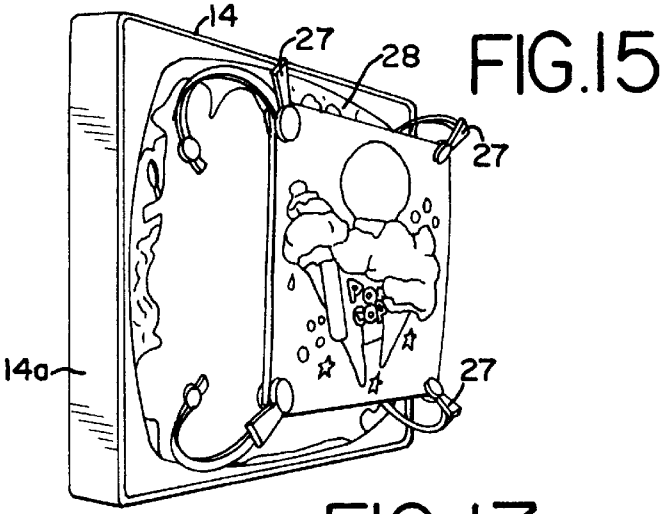
FIG. 15 is a perspective view of the preferred embodiment.
Figure 17:
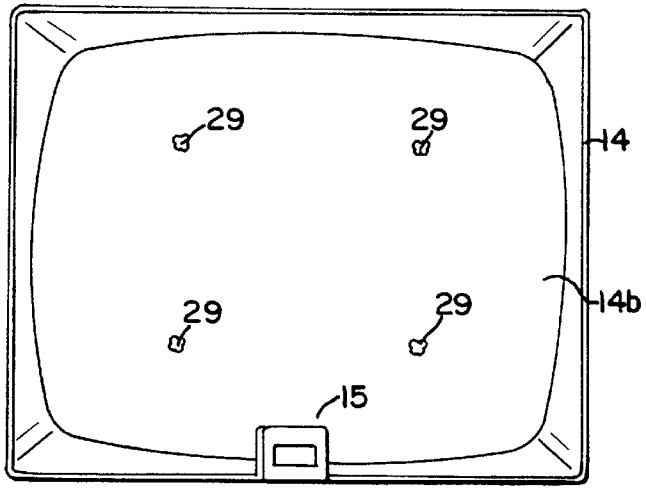
FIG. 17 is a bottom view of the preferred embodiment.
Figure 14:
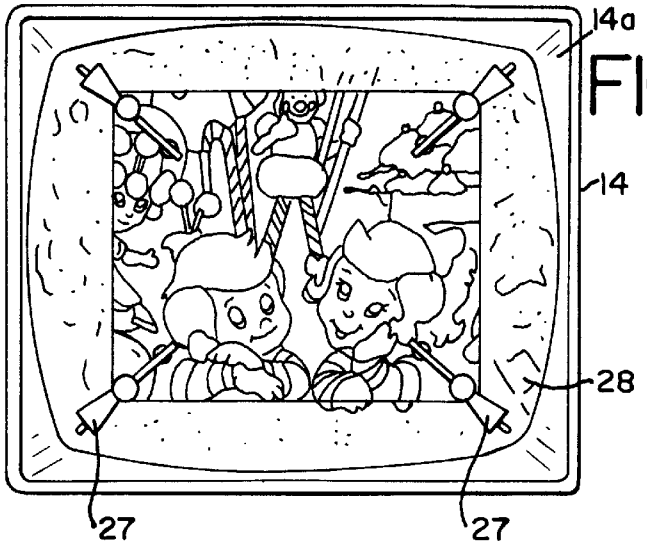
FIG. 14 is a top view of a preferred embodiment.
Figure 16B:
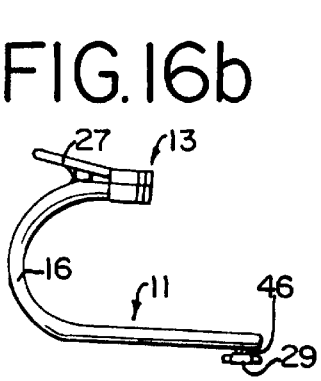
FIG. 16*b* is a side view of the supporting means and the holding means of the preferred embodiment.
Figure 16A:
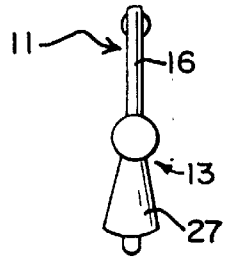
FIG. 16*a* is a top view of the holding means of the preferred embodiment.

FIGS. 14 through 17 depicts the preferred embodiment of the present invention. In this embodiment, the base 14 has a three dimensional sculptured rectangular box shape. As shown, the front surface 14*a* contains a surface or screen 28 where an image may be optionally displaced or illuminated through the front surface 14*a*. However, it is not necessary that the image be illuminated or that there even be a screen 28. As shown in FIG. 16, the means for supporting 11 is a strut 16 having a C shape. The strut 16 is preferably plastic but may be made of any one of a variety of materials. At the first end 11*a* of the means for supporting 11, the strut 16 is connected to the base 14 by an anchor bolt 46 that may snap fit, screw or simply twisted into a locking position through the strut 16 and the base 14. As clearly depicted in FIG. 17, at the opposite end, of the anchor bolt 46 has a decorative four leaf shaped cap 29. As shown in FIG. 14 and 15, the means for holding 13 is a plurality of plastic clips, each plastic clip 27 having two flat circular shapes designed to hold a flat object such as a picture in between. An optional plastic molded hook 44 is situated on the back surface 14*b* of the base for hanging the display device 10.

In the preferred embodiment, apertures (not shown) contained in the base 14 are cross or X shaped. Hence a corresponding cross or X shaped anchor bolt 46 is mounted at the end of the strut 16. This enables assembly by the purchaser which is not feasible for the wire-C strut described above. The anchor bolt 46 is preferably displaced slightly from the end of the strut 16, providing a dimension slightly less than the thickness of the screen 28. The preferred "X-shaped" anchor bolt 46 displaced in conjunction with the thickness of the screen 28 enables the connection of anchor bolt 46 through an aperture in a position rotated 90 degrees from the desired position. Rotation into position set anchor bolt 46 owning to the slight distortion of the plastic and friction with the screen. The anchor bolt 46 could also be keyed to permit rotation in only one direction and alignment in only one position.

It must be understood that certain variations of this display device can be made without departing from the scope of the present invention. The foregoing detailed description has been given only by way of example and various modifications will be readily apparent to those skilled in the art.

In accordance with my invention, I claim:

1. An apparatus for display of a substantially planar object, the apparatus comprising:

a base having a front surface, a back surface and a peripheral edge extending around said base; said front surface being visible when the object is displayed;

a means for supporting the object in a spaced relationship with said front surface of said base, said supporting means connected to said base at a point and projecting outwardly from said base; and a means for holding the object, said holding means being attached to said means for supporting, said means for holding comprising clips having a gripping portion for holding the object and a connecting portion attached to said means for supporting;

a base having a front surface and a back surface, and a peripheral edge extending therearound;

a means for supporting said art object in spaced substantially parallel relationship with said front surface of said base, said means for supporting being connected to said base at a point and protecting outwardly from said base, said means for supporting comprising a plurality of substantially rigid members attached substantially perpendicularly to the base;

a means for holding said art object, said holding means being attached to said means for supporting, said rigid members supporting said means for holding, said means for holding comprising a plurality of opposed brackets, each said bracket having a front flange, a rear flange, a side web joining said flange, and a bottom stop, said flanges, said stop and said web defining a slot, the object being supporting in the slots;

a base comprising a rigid front surface, a rigid back surface, a peripheral edge extending therearound said base having four apertures, each said aperture defining one corner of a rectangle;

a means for supporting the object in a spaced substantially parallel relationship with said front surface of said base, said means for supporting being connected to said base at a point and projecting outwardly from said base, said means for supporting comprising two flexible elongate members, each said elongate member being looped through two apertures and fixed to said base;

a means for holding the object, said holding means operatively connected to said elongate members and a plurality of clips, and said means for supporting comprises a plurality of struts, each said strut having a base leg merging into a curved leg to form a C shape.

2. The apparatus of claim 1 wherein said base leg and said curved leg are integrally connected.

3. The apparatus of claim 1 said front surface being a continuous broad surface curved toward the object; wherein said struts are molded to said base extending outward from said front surface.

4. The apparatus of claim 1 wherein said struts are snap fit into said base.

5. An apparatus for display of a substantially planar object, the apparatus comprising:

a substantially planar base having a front surface, a back surface and a peripheral edge extending around said base, said base being a three dimensional sculptured rectangular shaped box, said front surface of said base having a screen; said front surface having a perimeter portion adapted to be visible behind an object, whereby said front surface is visible when the object is displayed;

a means for supporting the object in a spaced relationship with said front surface of said base, said supporting means connected to said base at a point and projecting outwardly from said base, said supporting means comprising a C-shaped strut, said strut connected to said base by an anchor—fastener—; and a means for holding the object, said holding means connected to said means for supporting, said holding means comprising a plurality of plastic clips, each said plastic clip having two gripping members designed to hold a flat object therebetween.

* * * * *